US011739724B2

(12) United States Patent
Um

(10) Patent No.: US 11,739,724 B2
(45) Date of Patent: Aug. 29, 2023

(54) METHOD AND DEVICE FOR SELF-DIAGNOSING IGNITION COIL OF ENGINE OF VEHICLE

(71) Applicants: HYUNDAI MOTOR COMPANY, Seoul (KR); KIA CORPORATION, Seoul (KR)

(72) Inventor: Je Hyeon Um, Hwaseong-si (KR)

(73) Assignees: HYUNDAI MOTOR COMPANY, Seoul (KR); KIA CORPORATION, Seoul (KR)

( * ) Notice: Subject to any disclaimer, the term of this patent is extended or adjusted under 35 U.S.C. 154(b) by 0 days.

(21) Appl. No.: 17/736,560

(22) Filed: May 4, 2022

(65) Prior Publication Data

US 2023/0052720 A1 Feb. 16, 2023

(30) Foreign Application Priority Data

Aug. 11, 2021 (KR) ..... 10-2021-0106109

(51) Int. Cl.
*F02P 17/12* (2006.01)
*G07C 5/08* (2006.01)

(52) U.S. Cl.
CPC ..... *F02P 17/12* (2013.01); *G07C 5/0808* (2013.01); *G07C 5/0825* (2013.01)

(58) Field of Classification Search
CPC ..... F02P 17/12
USPC ..... 73/114.62; 123/630, 634; 324/383, 388
See application file for complete search history.

(56) References Cited

U.S. PATENT DOCUMENTS

| | | | | |
|---|---|---|---|---|
| 2,501,802 | A * | 3/1950 | Walker | F02P 17/00 324/383 |
| 2,548,056 | A * | 4/1951 | Powasnick | F02P 17/00 324/383 |
| 6,512,375 | B1 * | 1/2003 | Yamada | F02P 17/12 324/391 |
| 6,998,846 | B2 * | 2/2006 | Daniels | F02P 3/051 324/399 |
| 7,137,385 | B2 * | 11/2006 | Newton | F02P 5/1514 324/388 |
| 2003/0038635 | A1 * | 2/2003 | McQueeney | F02P 13/00 324/388 |
| 2019/0040834 | A1 * | 2/2019 | Nishio | F02P 17/12 |
| 2019/0353134 | A1 * | 11/2019 | Funato | F02B 31/00 |

* cited by examiner

*Primary Examiner* — Erick R Solis
(74) *Attorney, Agent, or Firm* — MCDONNELL BOEHNEN HULBERT & BERGHOFF LLP

(57) ABSTRACT

A method for self-diagnosing an ignition coil of an engine of a vehicle, which self-diagnoses an error of the ignition coil supplying voltage to a spark plug includes generating, by a self-diagnosis signal generating device included in the ignition coil, a fault flag signal by monitoring a discharge time of secondary current which flows on a secondary coil of the ignition coil, and generating, by a controller, a diagnostic trouble code (DTC) according to a duration of the fault flag signal.

8 Claims, 3 Drawing Sheets

METHOD AND DEVICE FOR SELF-DIAGNOSING IGNITION COIL OF ENGINE OF VEHICLE

CROSS REFERENCE TO RELATED APPLICATIONS

This application claims priority to and the benefit of Korean Patent Application No. 10-2021-0106109 filed in the Korean Intellectual Property Office on Aug. 11, 2021, the entire contents of which are incorporated herein by reference.

BACKGROUND

(a) Field

The present disclosure relates to a vehicle, and more particularly, to a method and a device for self-diagnosing an ignition coil of an engine of a vehicle.

(b) Description of the Related Art

Except for a case of a diesel engine in which self-ignition is made by using compression heat generated when a mixed gas is compressed at high pressure in an engine cylinder of a vehicle, an engine of the vehicle has an ignition coil. An ignition scheme is generally as follows. The ignition coil applies high voltage of thousands of volt to a spark plug electrode gap. The ignition coil serves to ignite and explode the mixed gas by generating a final flame discharge. A scheme in which the ignition coil generates the high voltage includes a storage battery ignition scheme by a battery and a magnetic ignition scheme by high-voltage magnet generation according to a power supplied to the ignition coil. A 4-stroke gasoline engine such as the engine of the vehicle is the storage battery ignition scheme.

An ignition coil as a kind of small transformer transforms battery voltage to 30 (kV) or more to generate a flame in a spark flag gap in an engine cylinder.

When an operation principle of the ignition coil is described, while an igniter which is a switch is electrically conducted according to an ignition signal of an electronic control unit, current gradually flows on a primary coil. In this case, when the current flows on the primary coil, a magnetic field is formed.

In addition, while the igniter is opened according to the ignition signal of the ECU, the current is interrupted in the primary coil. In this case, in a secondary coil, a rapid magnetic flux change is induced by a mutual induction action to generate secondary voltage (high voltage) according to a turn ratio.

Then, the secondary voltage is applied to a spark plug gap and is discharged while an electric field is broken to form a spark.

The above information disclosed in this Background section is only for enhancement of understanding of the background of the disclosure, and therefore it may contain information that does not form the prior art that is already known in this country to a person of ordinary skill in the art.

SUMMARY

The present disclosure has been made in an effort to provide a method and a device for self-diagnosing an ignition coil of an engine of a vehicle, which can generate a diagnostic trouble code (DTC) according to a duration of a fault flag signal.

An exemplary embodiment of the present disclosure provides a method for self-diagnosing an ignition coil of an engine of a vehicle, which may include calculating, by a controller, a duration of a fault flag signal generated based on a discharge time of secondary current which flows on a secondary coil of a transformer of an ignition coil supplying voltage to a spark plug and indicating an error of the ignition coil; and generating, by a controller, a diagnostic trouble code (DTC) according to the duration of the fault flag signal.

The controller may generate primary current which flows on a primary coil of the transformer by applying an ignition signal to a switch connected to a primary coil of the ignition coil through a self-diagnosis signal generating device included in the ignition coil to generate the secondary current, and the self-diagnosis signal generating device may generate the fault flag signal in response to the secondary current and transmit the generated fault flag signal to the controller.

The method may further include judging, by the controller, whether the fault flag signal is generated, increasing a value of a counter by a first reference value which is a value for allowing the controller to perform an error diagnosis of the ignition coil when the fault flag signal is generated, decreasing the value of the counter by a second reference value which is a value for allowing the controller not to perform the error diagnosis of the ignition coil and is smaller than the first reference value when the fault flag signal is not generated, and judging, by the controller, whether the value of the counter calculated by the first reference value and the second reference value is more than a reference counter value which is a value for allowing the controller to perform the error diagnosis of the ignition coil, in which when the value of the counter is more than the reference counter value, the controller may calculate the duration of the fault flag signal.

The method may further include controlling, by the controller, the display device to display the diagnostic trouble code to allow the diagnostic trouble code to be used for repairing the ignition coil.

Another exemplary embodiment of the present disclosure provides a device for self-diagnosing an ignition coil of an engine of a vehicle, which may include: the ignition coil supplying voltage to a spark plug, including a transformer, and generating a fault flag signal indicating an error of the ignition coil based on a discharge time of secondary current which flows on a secondary coil of the transformer, and a controller calculating a duration of the fault flag signal, and generating a diagnostic trouble code (DTC) corresponding to the duration of the fault flag signal.

The controller may primary current which flows on a primary coil of the transformer by applying an ignition signal to a switch connected to a primary coil of the ignition coil through a self-diagnosis signal generating device included in the ignition coil to generate the secondary current, and the self-diagnosis signal generating device may generate the fault flag signal in response to the secondary current and transmit the generated fault flag signal to the controller.

The controller may judge whether the fault flag signal is generated, the controller may increase a value of a counter by a first reference value which is a value for allowing the controller to perform an error diagnosis of the ignition coil, when the fault flag signal is generated, the controller may decrease the value of the counter by a second reference value which is a value for allowing the controller not to perform the error diagnosis of the ignition coil and is smaller than the first reference value when the fault flag signal is not generated, the controller may judge whether the value of the counter calculated by the first reference value and the second reference value is more than a reference counter value which is a value for allowing the controller to perform the error diagnosis of the ignition coil, and when the value of the counter is more than the reference counter value, the controller may calculate the duration of the fault flag signal.

The controller may control the display device to display the diagnostic trouble code.

Yet another exemplary embodiment of the present disclosure provides a method for self-diagnosing an ignition coil of an engine of a vehicle, which relates to a method for self-diagnosing an ignition coil of an engine of a vehicle, which self-diagnoses an error of the ignition coil supplying voltage to a spark plug, which may include: generating, by a self-diagnosis signal generating device included in the ignition coil, a fault flag signal by monitoring a discharge time of secondary current which flows on a secondary coil of the ignition coil; and generating, by a controller, a diagnostic trouble code (DTC) according to a duration of the fault flag signal.

The controller may generate primary current which flows on the primary coil by applying an ignition signal to a switch connected to a primary coil of the ignition coil to generate the secondary current through the self-diagnosis signal generating device, and the self-diagnosis signal generating device may generate the fault flag signal in response to the secondary current and transmit the generated fault flag signal to the controller.

The method may further include judging, by the controller, whether the fault flag signal is generated. increasing a value of a counter by a first reference value which is a value for allowing the controller to perform an error diagnosis of the ignition coil when the fault flag signal is generated, decreasing the value of the counter by a second reference value which is a value for allowing the controller not to perform the error diagnosis of the ignition coil and is smaller than the first reference value when the fault flag signal is not generated, and judging, by the controller, whether the value of the counter calculated by the first reference value and the second reference value is more than a reference counter value which is a value for allowing the controller to perform the error diagnosis of the ignition coil, in which when the value of the counter is more than the reference counter value, the controller may calculate the duration of the fault flag signal.

The method may further include controlling, by the controller, the display device to display the diagnostic trouble code to allow the diagnostic trouble code to be used for repairing the ignition coil.

Still yet another exemplary embodiment of the present disclosure provides a device for self-diagnosing an ignition coil of an engine of a vehicle which may include the ignition coil generating a fault flag signal by monitoring a discharge time of secondary current which flows on a secondary coil of the ignition coil supplying voltage a spark plug, and a controller generating a diagnostic trouble code (DTC) according to a duration of the fault flag signal.

The controller may generate primary current which flows on a primary coil by applying an ignition signal to a switch connected to a primary coil of the ignition coil to generate the secondary current through a self-diagnosis signal generating device included in the ignition coil, and the self-diagnosis signal generating device may generate the fault flag signal in response to the secondary current and transmit the generated fault flag signal to the controller.

The controller may judge whether the fault flag signal is generated, the controller may increase a value of a counter by a first reference value which is a value for allowing the controller to perform an error diagnosis of the ignition coil, when the fault flag signal is generated, the controller may decrease the value of the counter by a second reference value which is a value for allowing the controller not to perform the error diagnosis of the ignition coil and is smaller than the first reference value when the fault flag signal is not generated, the controller may judge whether the value of the counter calculated by the first reference value and the second reference value is more than a reference counter value which is a value for allowing the controller to perform the error diagnosis of the ignition coil, and when the value of the counter is more than the reference counter value, the controller may calculate the duration of the fault flag signal.

The controller may control the display device to display the diagnostic trouble code.

According to exemplary embodiments of the present disclosure, a method and a device for self-diagnosing an ignition coil of an engine of a vehicle can generate a diagnostic trouble code (DTC) according to a duration of a fault flag signal.

BRIEF DESCRIPTION OF THE FIGURES

A brief description of each drawing is provided in order to more sufficiently appreciate drawings used in a detailed description of the present disclosure.

DETAILED DESCRIPTION

Figure 1:
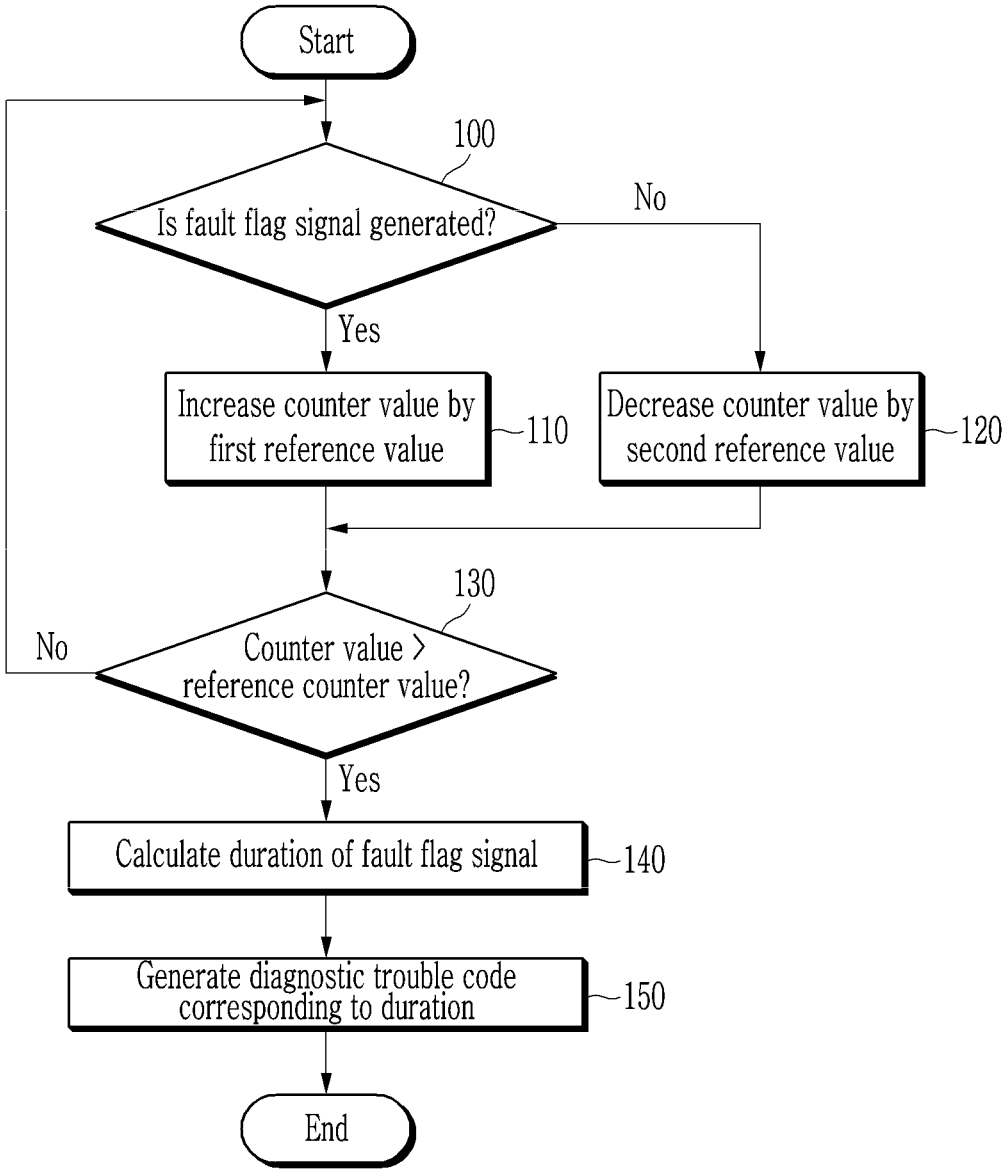
FIG. 1 is a flowchart for describing a method for self-diagnosing an ignition coil of an engine of a vehicle according to an exemplary embodiment of the present disclosure.

In order to sufficiently appreciate objects achieved by the present disclosure and exemplary embodiments of the present disclosure, accompanying drawings illustrating the exemplary embodiments of the present disclosure and contents disclosed in the accompanying drawings should be referred.

Hereinafter, the present disclosure will be described in detail by describing the exemplary embodiments of the present disclosure with reference to the accompanying drawings. In the following description, a detailed explanation of related known configurations or functions may be omitted to avoid obscuring the subject matter of the present disclosure. Like reference numerals presented in each drawing may refer to like elements.

Terms used in the present specification are used only to describe specific exemplary embodiments, and are not intended to limit the present disclosure. A singular form includes a plural form if there is no clearly opposite meaning in the context. In the present specification, it should be understood that term "include" or "have" indicates that a feature, a number, a step, an operation, a component, a part or the combination thereof described in the specification is present, but does not exclude a possibility of presence or addition of one or more other features, numbers, steps, operations, components, parts or combinations thereof, in advance.

Throughout the specification, when it is described that a part is "connected" with another part, it means that the certain part may be "directly connected" with another part and the parts "electrically or mechanically connected" to each other with a third element interposed therebetween as well.

If it is not contrarily defined, all terms used herein including technological or scientific terms have the same meanings as those generally understood by those skilled in the art (ordinary skilled in the art). Terms which are defined in a generally used dictionary should be interpreted to have the same meaning as the meaning in the context of the related art, and are not interpreted as an ideal meaning or excessively formal meanings unless clearly defined in the present specification.

Figure 2:
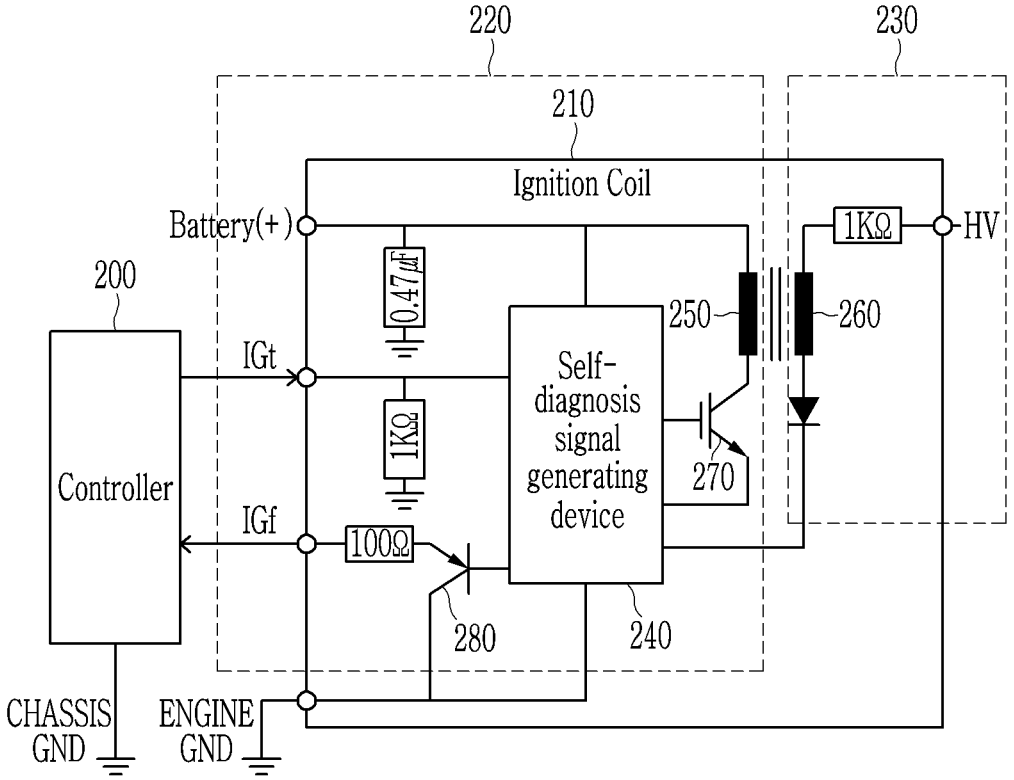
FIG. 2 is a diagram for describing a device for self-diagnosing an ignition coil of an engine of a vehicle to which the method for self-diagnosing an ignition coil of an engine of a vehicle illustrated in FIG. 1 is applied.
Figure 3:
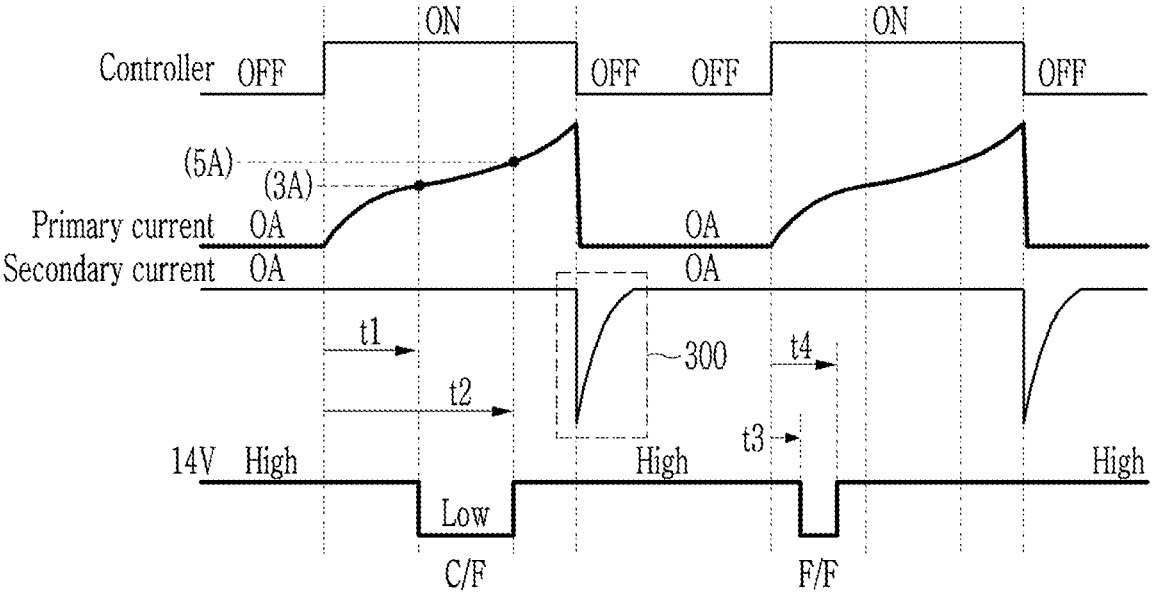
FIG. 3 is a timing diagram for describing an operation of the device for self-diagnosing an ignition coil of an engine of a vehicle illustrated in FIG. 2.

FIG. 1 is a flowchart for describing a method for self-diagnosing an ignition coil of an engine of a vehicle according to an exemplary embodiment of the present disclosure. FIG. 2 is a diagram for describing a device for self-diagnosing an ignition coil of an engine of a vehicle to which the method for self-diagnosing an ignition coil of an engine of a vehicle illustrated in FIG. 1 is applied. FIG. 3 is a timing diagram for describing an operation of the device for self-diagnosing an ignition coil of an engine of a vehicle illustrated in FIG. 2.

Referring to FIGS. 1 to 3, in a judgment step (100), a controller 200 may judge whether a fault flag (F/F) signal generated based on a discharge time (a time represented by reference numeral 300 of FIG. 3) of secondary current which flows on a secondary coil (wire) 260 of a transformer of an ignition coil 210 and indicating an error of the ignition coil is generated. The secondary current may be generated in response to the ignition signal of the controller 200. For example, a discharge time of the secondary current (or a normal discharge time of the secondary current) may be more than 0.2 (ms) and less than 7 (ms). When the discharge time (or a spark duration) of the secondary current is equal to or less than a first reference discharge time (e.g., 0.2 (ms)) or equal to or more than a second reference discharge time (e.g., 7 (ms)), the fault flag signal indicating an error (e.g., misfire) of the ignition coil 210 may be generated.

The controller 200 generates the primary current which flows on the primary coil of the transformer by applying an ignition signal IGt to a switch 270 connected to a primary coil 250 of the transformer of the ignition coil through a self-diagnosis signal generating device 240 included in the ignition coil 210 to generate the secondary current. The self-diagnosis signal generating device 240 may generate the fault flag signal in response to the secondary current (or by monitoring the secondary current), and transmit the generated fault flag signal to the controller 200.

As illustrated in FIG. 3, a self-diagnosis signal IGf transmitted from the self-diagnosis signal generating device 240 to the controller 200 may include a current flag signal C/F and a fault flag signal F/F.

The current flag signal C/F may be generated in a form of a square wave when the primary current passes through a specific current value, 2 points (e.g., 3 (A), 5 (A)). Each generation time of the current flag signal C/F as a time when passing through the specific current value, 2 points may be t1 and t2 based on a start point of an electrical conduction time of the primary coil 250.

The fault flag signal F/F may be generated based on the discharge time of the secondary current after the current flag signal C/F is generated, and generated in the form of the square wave after the electrical conduction time of the next primary coil 250. The generation time of the fault flag signal F/F may be t3 (e.g., 75±25 (μs)) and t4 (e.g., 375±50 (μs)) based on the start point of the electrical conduction time of the next primary coil 250.

The current flag signal C/F should be continuously transmitted to the controller 200, and the fault flag signal F/F may be transmitted after the start point of the electrical conduction time of the next primary coil 250 only when it is judged that the ignition coil 210 is erroneous according to the discharge time of the secondary current. The controller 200 may continuously receive the current flag signal C/F, and judge that the ignition coil 210 is normal when the fault flag signal F/F is not received.

The current flag signal C/F and the fault flag signal F/F may not be simultaneously transmitted within an electrical conduction time of the same primary coil 250, and the current flag signal C/F is not transmitted when the fault flag signal F/F is transmitted.

The device for self-diagnosing an ignition coil of an engine of a vehicle may include the controller 200 and the ignition coil (or sparking coil) 210. The ignition coil 210 may include a primary circuit 220 of the transformer and a secondary circuit 230 of the transformer.

The primary circuit 220 may include the self-diagnosis signal generating device 240 which is an electronic circuit, the primary coil (wire) 250, an igniter 270 which is a switch (e.g., an insulated gate bipolar transistor (IGBT) which is a power transistor), a signal transfer transistor (e.g., a bipolar junction transistor (BJT)) 280 transferring the fault flag signal IGf, resistors, and a capacitor. The secondary circuit 230 may include a secondary coil (wire) 260, a diode, and the resistor. A battery (e.g., a battery having output voltage of 14 volt) may supply power to the self-diagnosis signal generating device 240 and the primary coil 250.

The ignition coil (or ignition device) 210 may be a device that causes a flame discharge by applying high voltage of tens of thousands of volt or more to an electrode gap of a spark plug, and sends flame energy to the inside of a cylinder of an engine (e.g., a gasoline engine) to ignite and combust mixed gas compressed in a combustion room with an electrical flame at an appropriate time. Additionally, when the igniter (IGT) 270 is electrically conducted according to the ignition signal of the controller 200, the current gradually flows on the primary coil 250 to form a magnetic field. When the igniter (IGT) 270 is interrupted (opened) according to the ignition signal of the controller 200, the primary current is interrupted, and a rapid magnetic flux change is induced to the secondary circuit 230 by a mutual induction action (electromagnetic induction phenomenon), and as a result, high voltage (secondary voltage) may be generated according to a turn ratio. The secondary voltage is applied to the spark plug gap in the engine cylinder, and as a result, the electric field is broken and discharged to form a flame.

The controller 200 as an electronic control unit (ECU) such as an engine controller controlling the engine igniting fuel by using the spark plug to which the secondary current which flows on the secondary coil of the ignition coil is supplied may control an overall operation of the device for self-diagnosing an ignition coil of an engine of a vehicle. The controller 200 may be, for example, one or more microprocessors which operate by a program (control logic) or hardware (e.g., a microcomputer) including the microprocessors, and the program may include a series of instructions for performing the method for self-diagnosing an ignition coil of an engine of a vehicle according to an exemplary embodiment of the present disclosure. The instructions may be stored in a memory of the device for self-diagnosing an ignition coil of an engine of a vehicle or the controller 200.

When the fault flag signal is generated, the method for self-diagnosing an ignition coil of an engine of a vehicle which is a process may proceed to step 110 and when the fault flag signal is not generated, the method for self-diagnosing an ignition coil of an engine of a vehicle which is the process may proceed to step 120.

According to step 110, the controller 200 may increase a value of a counter by a first reference value (e.g., 2). For example, the counter may be included in the controller. The first reference value may be a value for allowing the controller 200 to perform an error diagnosis of the ignition coil 210, and may be stored in the memory of the device for self-diagnosing an ignition coil of an engine of a vehicle or the controller 200, and determined by a test (or an experiment).

According to step 120, the controller 200 may decrease the value of the counter by a second reference value (e.g., 1). The second reference value may be a value for allowing the controller 200 not to perform an error diagnosis of the ignition coil 210, and may be smaller than the first reference value, and may be stored in the memory of the device for self-diagnosing an ignition coil of an engine of a vehicle or the controller 200, and determined by a test (or an experiment).

According to step 130, the controller 200 may judge whether the values of the counter calculated in step 110 and step 120 are more than a reference counter value (or a counter reference value) (e.g. 10). The reference counter value may be a value for allowing the controller 200 to perform an error diagnosis of the ignition coil, and stored in the memory of the device for self-diagnosing an ignition coil of an engine of a vehicle or the controller 200, and determined by a test (or an experiment).

When the value of the counter is more than the reference counter value, the method for self-diagnosing an ignition coil of an engine of a vehicle which is the process may proceed to step 140 and when the value of the counter is equal to or less than the reference counter value, the method for self-diagnosing an ignition coil of an engine of a vehicle which is the process may proceed to step 100.

The ignition coil 210 is not in an error state, but in a normal state, but when the fault flag signal is temporarily generated, the controller 200 may not perform the error diagnosis of the ignition coil through step 100, step 110, and step 120. For example, when the engine is started or the engine operates at a low speed, the fault flag signal may be generated due to external noise applied to the ignition coil 210.

According to step (40, the controller 200 may calculate a duration (a generation time or a required time) of the fault flag (F/F) signal. For example, the duration of the fault flag signal may be more than 225 (μs) and less than 375 (μs).

According to step 150, the controller 200 may generate a diagnostic trouble code (DTC) corresponding to the duration of the fault flag (F/F) signal. In another exemplary embodiment of the present disclosure, the controller 220 may allow the diagnostic trouble code to be used for repairing the ignition coil by controlling a display device so that the display device (e.g., a cluster) of the device for self-diagnosing an ignition coil of an engine of a vehicle displays the diagnostic trouble code. The diagnostic trouble code corresponding to the duration of the fault flag signal may be stored in the memory of the device for self-diagnosing an ignition coil of an engine of a vehicle or the controller 200, and determined by a test (or an experiment).

For example, a case where the duration of the fault flag signal is more than 225 (μs) and equal to or less than 245 (μs) may correspond to a diagnostic trouble code (DTC) indicating a case where errors (e.g., a short-circuit between the primary coil 250 and the secondary coil 260 or a fault of the igniter 270 which is the switch) of at least two ignition coils simultaneously occur, a case where the duration of the fault flag signal is more than 245 (μs) and equal to or less than 265 (μs) may correspond to a diagnostic trouble code (DTC) indicating a case where an operation of the ignition coil is shut down by generating the primary current of the transformer of the ignition coil 210 for a reference value (e.g., 32 (ms)) or more, a case where the duration of the fault flag signal is more than 265 (μs) and equal to or less than 285 (μs) may correspond to a diagnostic trouble code (DTC) indicating a case where the discharge time of the secondary current which flows on the secondary coil 260 of the transformer of the ignition coil 210 is equal to or less than a first reference discharge time (e.g., 0.2 (ms)), and as a result, the ignition coil does not generate the spark, a case where the duration of the fault flag signal is more than 285 (μs) and equal to or less than 305 (μs) may correspond to a diagnostic trouble code (DTC) indicating a case where the discharge time of the secondary current which flows on the secondary coil 260 of the transformer of the ignition coil 210 is equal to or more than a second reference discharge time (e.g., 7 (ms)), and as a result, the ignition coil excessively generates the spark, and a case where the duration of the fault flag signal is more than 285 (μs) and less than 375 (μs) may correspond to a diagnostic trouble code (DTC) indicating the error of the ignition coil 210 due to overheat of the igniter 270 which is the switch.

A component, "unit", or block or module used in the exemplary embodiment of the present disclosure may be implemented as software such as a task, a class, a sub routine, a process, an object, an execution thread, and a program performed in a predetermined area on the memory or hardware such as field programmable gate array (FPGA) or application-specific integrated circuit (ASIC) and further, may be achieved by combining the software and the hardware. The component or 'unit' may be included in a computer readable storage medium and some of the component or 'unit' may be dispersedly distributed in a plurality of computers.

As described above, the embodiment is disclosed in the drawings and the specification. Although specific terms have been used herein, the terms are only used for the purpose of describing the present disclosure and are not used to limit the scope of the present disclosure as defined in the claims. Therefore, those skilled in the art will appreciate that various modifications and equivalent embodiments can be made from the present disclosure. Accordingly, the true technical scope of the present disclosure should be defined by the technical spirit of the appended claims.

The invention claimed is:

1. A method for self-diagnosing an ignition coil of an engine of a vehicle, which self-diagnoses an error of the ignition coil configured to supply voltage to a spark plug, the method comprising:

generating, by a self-diagnosis signal generating device included in the ignition coil, a fault flag signal by monitoring a discharge time of a secondary current which flows on a secondary coil of the ignition coil; and generating, by a controller, a diagnostic trouble code (DTC) according to a duration of the fault flag signal.

2. The method of claim 1, wherein:

the controller generates a primary current which flows on a primary coil by applying an ignition signal to a switch connected to the primary coil of the ignition coil to generate the secondary current through the self-diagnosis signal generating device; and the self-diagnosis signal generating device generates the fault flag signal in response to the secondary current and transmits the generated fault flag signal to the controller.

3. The method of claim 1, further comprising:

determining, by the controller, whether the fault flag signal is generated;

increasing a value of a counter by a first reference value which is a value for allowing the controller to perform an error diagnosis of the ignition coil when the fault flag signal is generated;

decreasing the value of the counter by a second reference value which is a value for allowing the controller not to perform the error diagnosis of the ignition coil and is smaller than the first reference value when the fault flag signal is not generated; and determining, by the controller, whether the value of the counter calculated by the first reference value and the second reference value is more than a reference counter value which is a value for allowing the controller to perform the error diagnosis of the ignition coil;

wherein when the value of the counter is more than the reference counter value, the controller calculates the duration of the fault flag signal.

4. The method of claim 1, further comprising:

controlling, by the controller, the display device to display the diagnostic trouble code to allow the diagnostic trouble code to be used for repairing the ignition coil.

5. A device for self-diagnosing an ignition coil of an engine of a vehicle, the device comprising:

an ignition coil generating a fault flag signal by monitoring a discharge time of secondary current which flows on a secondary coil of the ignition coil supplying voltage to a spark plug; and a controller generating a diagnostic trouble code (DTC) according to a duration of the fault flag signal.

6. The device of claim 5, wherein:

the controller generates a primary current which flows on a primary coil by applying an ignition signal to a switch connected to the primary coil of the ignition coil to generate the secondary current through a self-diagnosis signal generating device included in the ignition coil; and the self-diagnosis signal generating device generates the fault flag signal in response to the secondary current and transmits the generated fault flag signal to the controller.

7. The device of claim 5, wherein:

the controller determines whether the fault flag signal is generated;

the controller increases a value of a counter by a first reference value which is a value for allowing the controller to perform an error diagnosis of the ignition coil, when the fault flag signal is generated;

the controller decreases the value of the counter by a second reference value which is a value for allowing the controller not to perform the error diagnosis of the ignition coil and is smaller than the first reference value when the fault flag signal is not generated;

the controller determines whether the value of the counter calculated by the first reference value and the second reference value is more than a reference counter value which is a value for allowing the controller to perform the error diagnosis of the ignition coil; and when the value of the counter is more than the reference counter value, the controller calculates the duration of the fault flag signal.

8. The device of claim 5, wherein the controller controls the display device to display the diagnostic trouble code.

* * * * *